US008063828B2

(12) United States Patent
Xu et al.

(10) Patent No.: US 8,063,828 B2
(45) Date of Patent: Nov. 22, 2011

(54) SOLID ANTENNA

(75) Inventors: Su Xu, Shenzhen (CN); Mao-Hsiu Hsu, Taipei Hsien (TW)

(73) Assignees: Hong Fu Jin Precision Industry (ShenZhen) Co., Ltd., Shenzhen, Guangdong Province (CN); Hon Hai Precision Industry Co., Ltd., Tu-Cheng, New Taipei (TW)

( * ) Notice: Subject to any disclaimer, the term of this patent is extended or adjusted under 35 U.S.C. 154(b) by 594 days.

(21) Appl. No.: 12/211,038

(22) Filed: Sep. 15, 2008

(65) Prior Publication Data

US 2009/0267840 A1 Oct. 29, 2009

(30) Foreign Application Priority Data

Apr. 28, 2008 (CN) ..... 2008 1 0301380

(51) Int. Cl.
*H01Q 1/38* (2006.01)

(52) U.S. Cl. ..... 343/700 MS; 343/702; 343/895

(58) Field of Classification Search ..... 343/700 MS, 343/702, 895

See application file for complete search history.

(56) References Cited

U.S. PATENT DOCUMENTS 5,363,114 A 11/1994 Shoemaker
6,124,831 A * 9/2000 Rutkowski et al. .... 343/700 MS
6,198,442 B1 * 3/2001 Rutkowski et al. ..... 343/702
6,639,559 B2 * 10/2003 Okabe et al. ..... 343/700 MS
6,707,427 B2 * 3/2004 Konishi et al. ..... 343/700 MS
6,806,832 B2 * 10/2004 Sato et al. ..... 343/700 MS
7,136,021 B2 * 11/2006 Huang et al. ..... 343/702
7,215,288 B2 5/2007 Park et al.

FOREIGN PATENT DOCUMENTS

CN 1226808 C 11/2005
TW I285455 8/2007

* cited by examiner

*Primary Examiner* — Douglas W Owens
*Assistant Examiner* — Chuc Tran
(74) *Attorney, Agent, or Firm* — Altis Law Group, Inc.

(57) ABSTRACT

A solid antenna positioned on a substrate, includes a feeding portion for feeding electromagnetic signals and a radiating portion for transceiving the electromagnetic signals. The radiating portion includes a first radiator, a second radiator, a third radiator, a fourth radiator, a first connecting section, and a second connecting section. The first radiator and the second radiator are positioned on a first plane, and respectively comprise a first inverted-U-shaped radiating section and a second inverted-U-shaped radiating section. The third U-shaped radiator is positioned on a second plane perpendicular to the first plane. The first connecting section connects the first radiator to the third radiator. The second connecting section connects the second radiator to the third radiator. The fourth radiator is connected to the second radiator. The first connecting section, the second connecting section, and the fourth radiator comprise one radiating section positioned on a third plane.

18 Claims, 5 Drawing Sheets

SOLID ANTENNA

BACKGROUND

1. Field of the Invention

Embodiments of the present disclosure relate to antennas, and particularly to a solid antenna.

2. Description of Related Art

With the development of wireless communication technologies, wireless communication devices, such as mobile phones, notebook computers, and personal digital assistants (PDAs), are now in widespread use. When combined with communication modules, wireless communication devices can connect to local area networks (LAN), transceive E-mail, and download real time information, such as news and stock quotes.

Antennas are necessary components in wireless communication devices for radiating electromagnetic signals. In order to obtain compact wireless communication devices, the antennas associated therewith are correspondingly required to be small in size, at the same time maintaining adequate performance standards.

SUMMARY

An exemplary embodiment of the present disclosure provides a solid antenna. The solid antenna is positioned on a substrate, and comprises a feeding portion and a radiating portion. The feeding portion is configured for feeding electromagnetic signals. The radiating portion is configured for transceiving the electromagnetic signals, and comprises a first radiator, a second radiator, a third radiator, a fourth radiator, a first connecting section, and a second connecting section. The first radiator is positioned on a first plane, and electrically connects to the feeding portion. The first radiator comprises a first inverted-U-shaped radiating section. The second radiator is positioned on the first plane, and comprises a second inverted-U-shaped radiating section. The third radiator is U-shaped, and positioned on a second plane. The second plane is perpendicularly to the first plane. The first connecting section electrically connects the first radiator to the third radiator. The second connecting section electrically connects the second radiator to the third radiator. The fourth radiator electrically connects to the second radiator. The first connecting section, the second connecting section, and the fourth radiator comprise one radiating section positioned on a third plane.

Another exemplary embodiment of the present disclosure provides a solid antenna. The solid antenna comprises a feeding portion and a radiating portion. The feeding portion is configured for feeding electromagnetic signals. The radiating portion comprises a plurality of radiating sections connected one-by-one to collectively form a helical-shaped configuration. A first rectangular-shaped radiating section positioned in the periphery of the helical-shaped configuration of the radiating portion electrically connects to the feeding portion, and in the center of the helical-shaped configuration of the radiating portion is a free section. Some radiating sections adjacent to the feeding portion are positioned on a first plane, and other radiating sections apart from the feeding portion are positioned on a second plane.

Other advantages and novel features of the present disclosure will become more apparent from the following detailed description of certain inventive embodiments when taken in conjunction with the accompanying drawings, in which:

DETAILED DESCRIPTION

Figure 1:
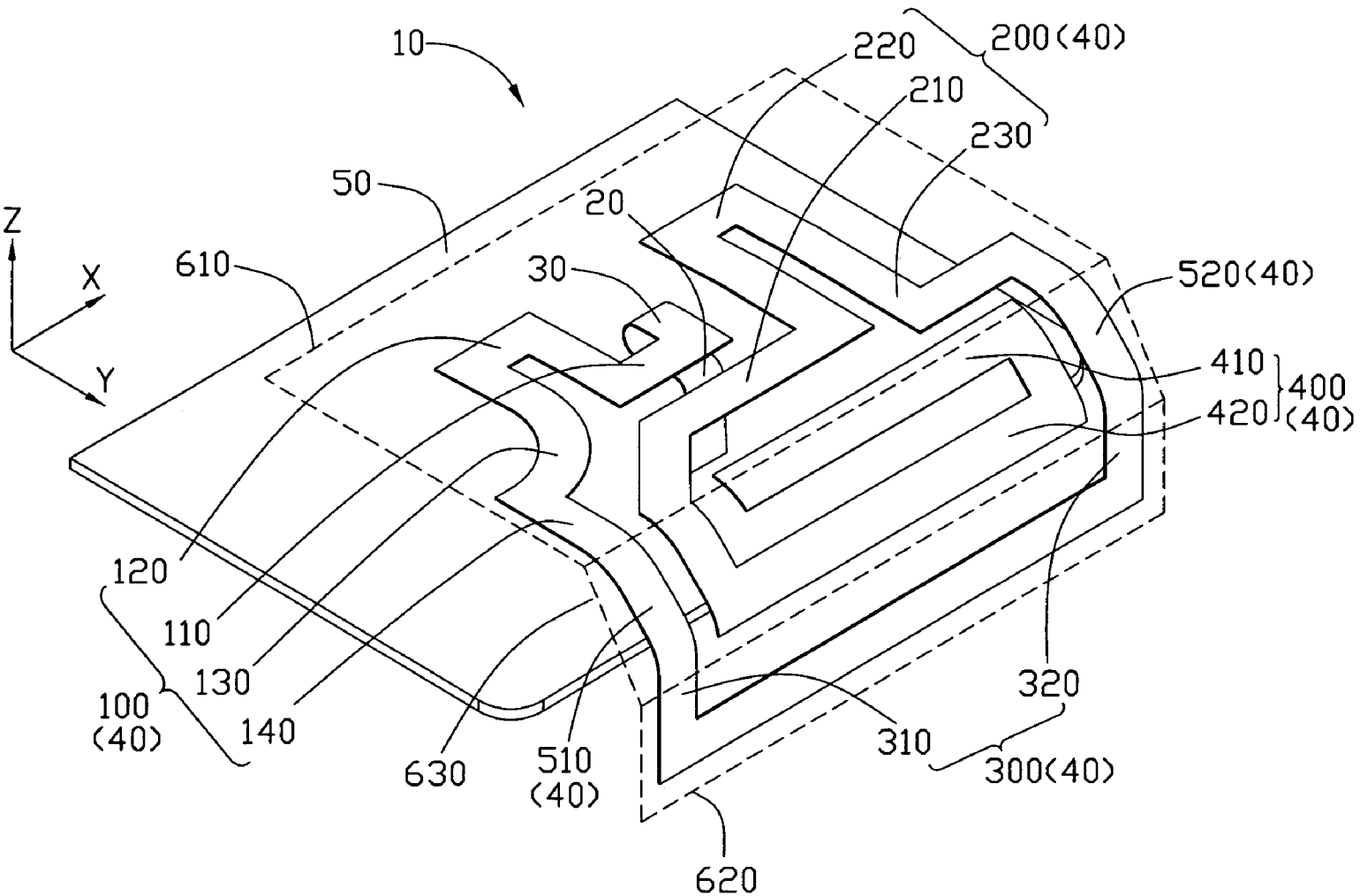
FIG. 1 is a schematic diagram of a solid antenna in accordance with an exemplary embodiment of the present disclosure.
Figure 2:
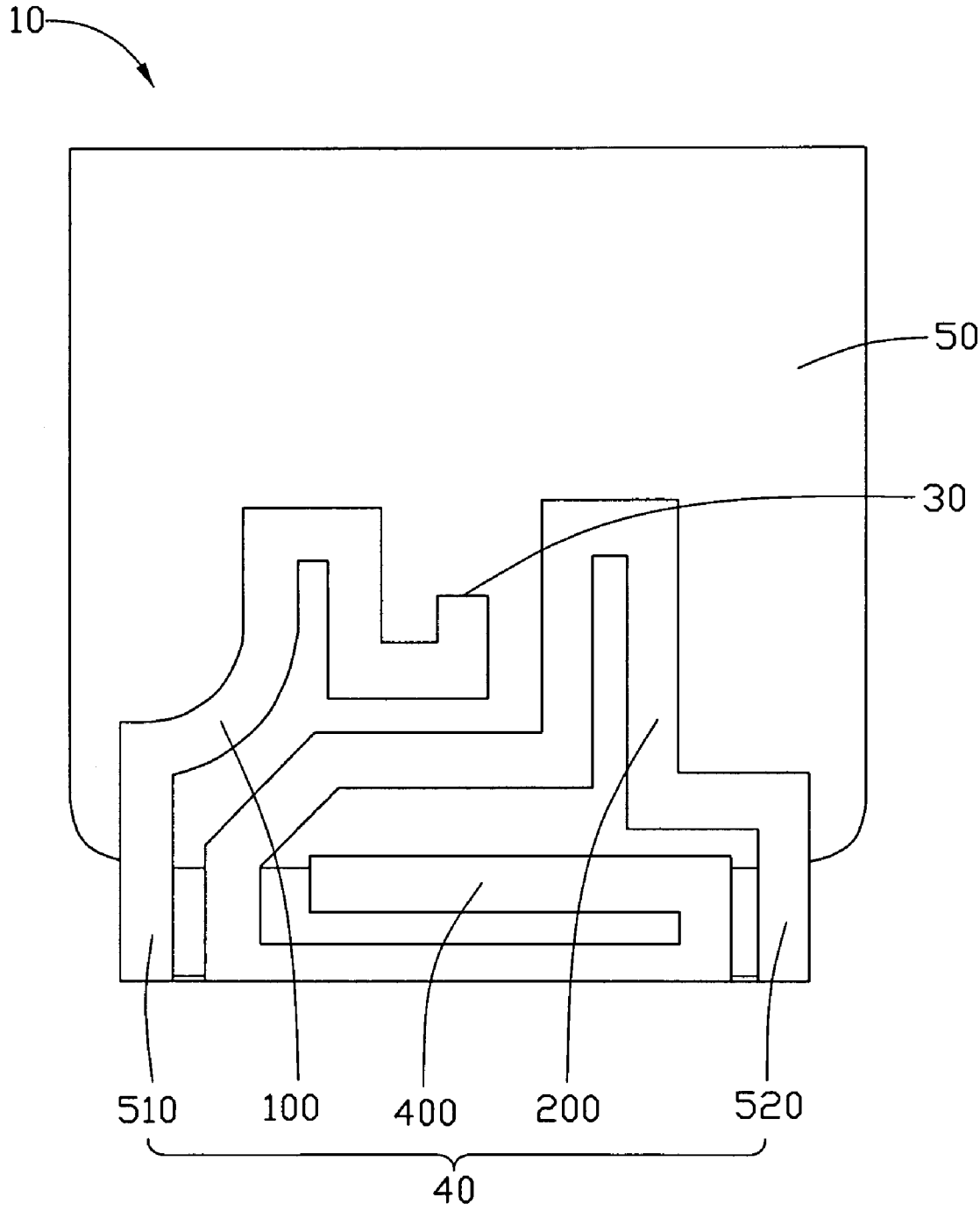
FIG. 2 is a top view of the solid antenna of the FIG. 1.

FIG. 1 is a schematic diagram of a solid antenna 10 in accordance with one embodiment of the present disclosure. In one embodiment, the solid antenna 10 is positioned on a substrate 50, and includes a feeding portion 20 and a radiating portion 40. In one embodiment, the substrate 50 may comprise a printed circuit board (PCB).

The feeding portion 20 feeds electromagnetic signals to the solid antenna 10. In one embodiment, the feeding portion 20 may be rectangularly-shaped, and perpendicularly connects to the substrate 50.

The radiating portion 40 electronically connects to the feeding portion 20 and transceives electromagnetic signals. The radiating portion 40 includes a plurality of radiating sections connected one-by-one to collectively form a helical-shaped configuration. A first rectangular-shaped radiating section 110 is positioned in the periphery of the helical-shaped configuration of the radiating portion 40, and electrically connects to the feeding portion 20. In the center of the helical-shaped configuration of the radiating portion 40 is a free section 410. In one embodiment, the radiating sections of the radiating portion 40 include a first radiator 100, a second radiator 200, a third radiator 300, a fourth radiator 400, a first connecting section 510, and a second connecting section 520.

It may be understood that the first radiator 100, the second radiator 200, the third radiator 300, the fourth radiator 400, the first connecting section 510, and the second connecting section 520 of the radiating portion 40 may be positioned on different planes of the substrate 40. The different planes on the substrate may be angled differently according to the Z and Y-axis of a coordinate axis-system.

As shown in FIG. 1, the first radiator 100 is positioned on a first plane 610, and includes a first rectangular-shaped radiating section 110, a first inverted-U-shaped radiating section 120, an arc-shaped radiating section 130, and a second rectangular-shaped radiating section 140, connected to each other one-by-one in sequence. In one embodiment, the first rectangular-shaped radiating section 110 of the radiating portion 100 electrically connects to the feeding portion 20. In one embodiment, the first plane 610 is parallel to the substrate 50, a second plane 620 is perpendicular to the first plane 610 and the substrate 50, and a third plane 630 intersects with the first plane 610 and the second plane 620 angularly.

The second radiator 200 is also positioned on the first plane, and includes a first S-shaped radiating section 210, a second inverted-U-shaped radiating section 220, and a second S-shaped radiating section 230, which are connected to each other one-by-one in sequence. In one embodiment, the second inverted-U-shaped radiating section 220 has substantially the same shape and opening direction as the first inverted-U-shaped radiating section 120.

The third radiator 300 is U-shaped and positioned on the second plane. The third radiator 300 includes a first connecting end 310 and a second connecting end 320.

In one embodiment, the third radiator 300 comprises an opening direction that is opposite to an opening direction of first inverted-U-shaped radiating section 120 and an opening direction of the second inverted-U-shaped radiating section 220. The size of the opening of the third radiator 300 is bigger than that of the opening of the first inverted-U-shaped radiating section 120 and of the opening of the second inverted-U-shaped radiating section 220.

The first connecting section 510 connects the first radiator 100 to the third radiator 300. In one embodiment, the first connecting section 510 connects the second rectangular-shaped radiating section 140 of the first radiator 100 to the first connecting end 310 of the third radiator 300. The projection of the first connecting section 510 onto the substrate 50 is rectangular-shaped.

The second connecting section 520 connects the second radiator 200 to the third radiator 300. In one embodiment, the second connecting section 520 connects the second S-shaped radiating section 230 of the second radiator 200 to the second connecting end 320 of the third radiator 300. The projection of the second connecting section 520 onto the substrate 50 is rectangular-shaped.

In one embodiment, the first radiator 100, the first connecting section 510, the third radiator 300, the second connecting section 520, the second inverted-U-shaped radiating section 220, and the second S-shaped radiating section 230 of the second radiator 200 are in the periphery of the helical-shaped configuration of the radiating portion 40.

The fourth radiator 400 electrically connects to the first S-shaped radiating section 210 of the second radiator 200. The fourth radiator 400 includes a free section 410 and a U-shaped radiating section 420 electrically connecting to the free section 410. In one embodiment, the fourth radiator 400 is apart from the feeding portion 20. The free section 410 is the last radiating section of the radiating portion 40 in the center of the helical-shaped configuration. The fourth radiator 400 is inverted-C shaped, and the projection of the fourth radiator 400 onto the substrate 50 is inverted-C shaped.

In one embodiment, the opening direction of the fourth radiator 400 is the same as that of the opening direction of the third radiator 300, and the size of the opening of the fourth radiator 400 is smaller than that of the size of the opening of the third radiator 300.

The first connecting section 510, the second connecting section 520, and the fourth radiator 400 includes one radiation section positioned on the third plane 630.

In one embodiment, the third plane 630 may be a flat plane. The first connecting section 510, the second connecting section 520, and the fourth radiator 400 may be positioned on the first plane 610, the second plane 620, and the third flat plane 630.

In another embodiment, the third plane 630 may comprise a curved surface. The first connecting section 510, the second connecting section 520, and the fourth radiator 400 may be positioned on the curved surface 630.

The solid antenna 10 further includes a supporting portion 30. The supporting portion 30 electrically connects the first rectangular-shaped radiating section 110 to the feeding portion 20.

Figure 3:
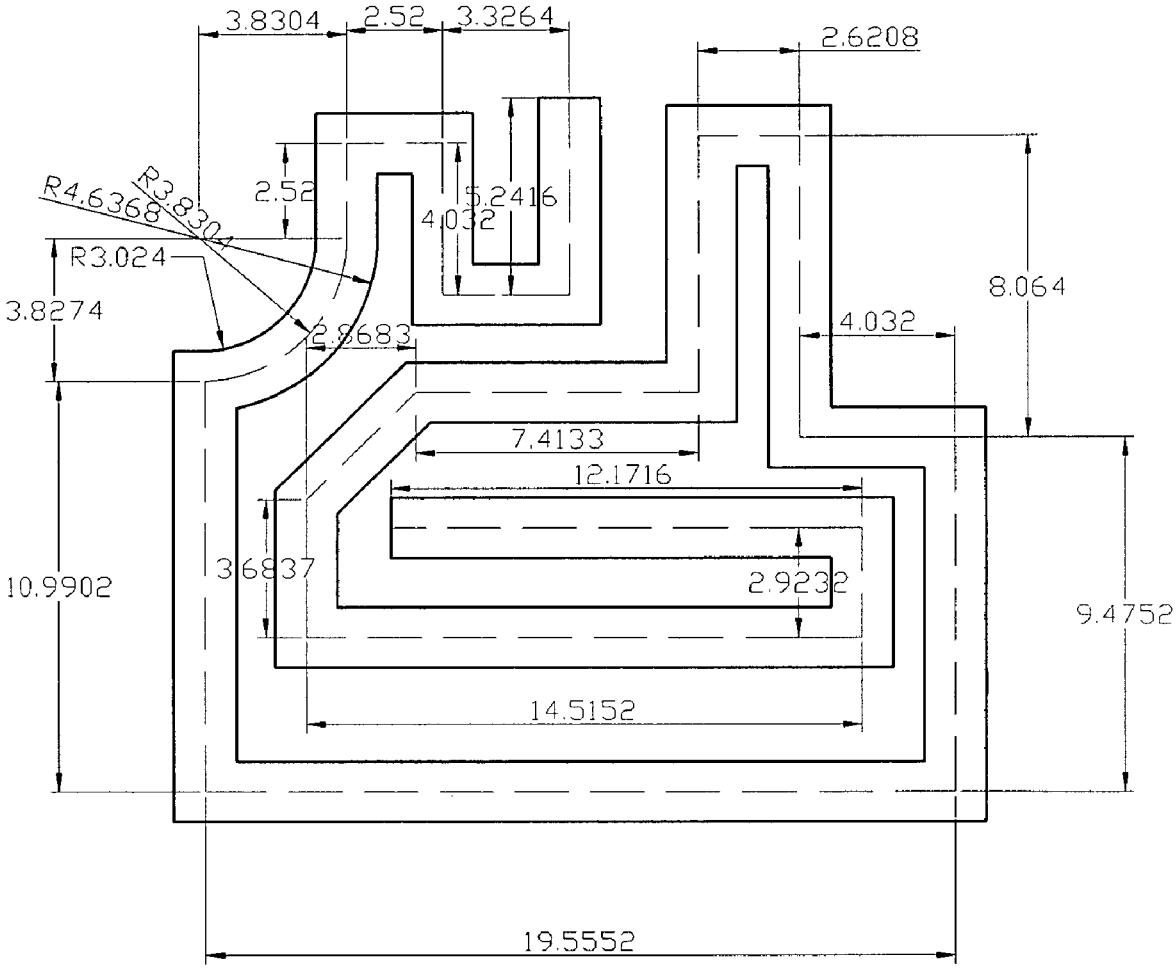
FIG. 3 illustrates one exemplary embodiment of the solid antenna of the FIG. 1 illustrating exemplary expanding dimensions.

FIG. 3 illustrates one exemplary embodiment of the solid antenna of the FIG. 1 illustrating exemplary dimensions. In one embodiment, the length of the supporting portion 30 is approximately 5.2416 millimeters (mm). The length of the first rectangular-shaped radiating section 110 is approximately 3.3264 mm. The height of the first inverted-U-shaped radiating section 120 is approximately 2.52 mm, and the width thereof is approximately 2.52 mm. The inside-radius of the arc-shaped radiating section 130 is approximately 3.8304 mm, and the outside-radius thereof is approximately 4.6368 mm. The total length of the second rectangular-shaped radiating section 140, the first connecting section 510, and the first connecting end 310 is approximately 10.9902 mm. The length of the center section of the third radiator 300 is approximately 19.5552 mm. The total length of the second connecting end 320, the second connecting section 520, and the second S-shaped radiating 230 is approximately 9.4752 mm. The length of the center of the second S-shaped radiating section 230 is approximately 4.032 mm. The total height of the end of the second S-shaped radiating section 230 and the second inverted-U-shaped radiating section 220 is approximately 8.064 mm. The width of the second inverted-U-shaped radiating section 220 is approximately 2.6208 mm. The length of the center section of the first S-shaped radiating section 210 is approximately 7.4133 mm. The end of the first S-shaped radiating section is trapezial-shaped, and the length of the level is 2.8683 mm. The height of the end of the U-shaped radiating section 420 is 3.6837 mm. The height of the other end is 2.9232 mm. The length of the center radiating section of the fourth radiator 400 is 14.5152 mm. The length of the free section 410 is 12.1716 mm. It may be appreciated that FIG. 3 is an exemplary embodiment and smaller and larger antennas may be made without departing away from the spirit of the present disclosure.

Figure 4:
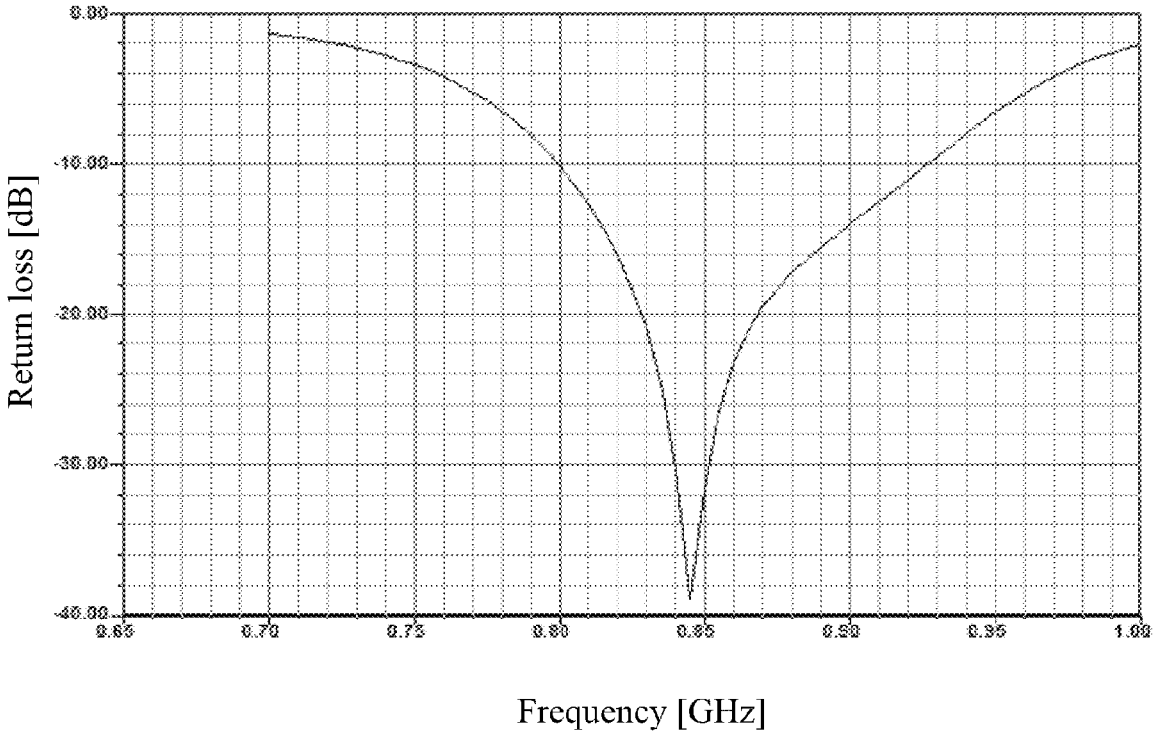
FIG. 4 is a graph showing one exemplary return loss of the solid antenna of FIG. 1.

FIG. 4 is a graph showing one exemplary return loss of the solid antenna of FIG. 1. As shown, the return loss is less than −10 dB when the solid antenna 10 operates at frequencies of approximately 824-894 MHz in code division multiple access (CDMA) standard.

Figure 5:
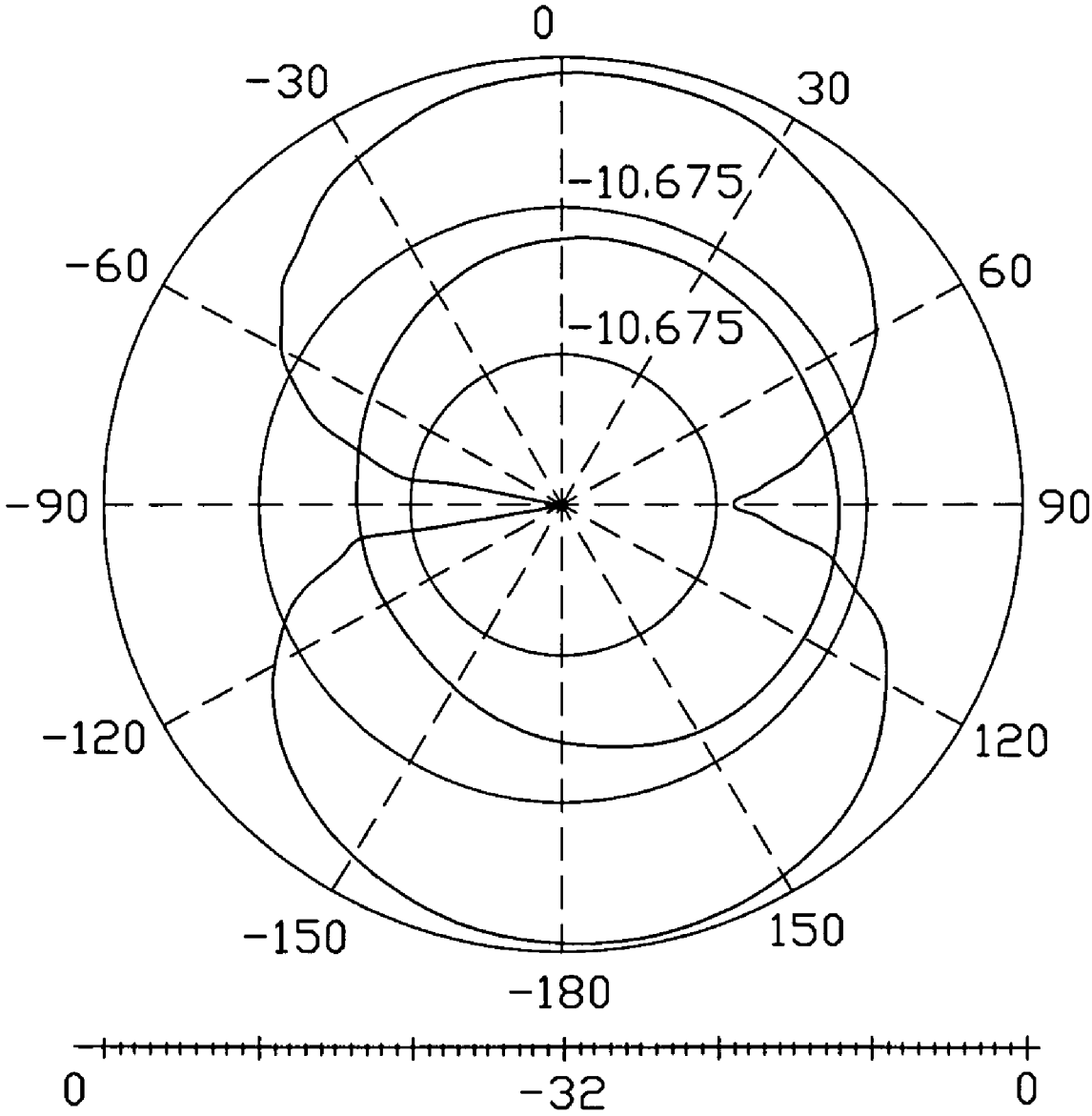
FIG. 5 is a test chart showing exemplary radiation patterns on X-Y plane when the solid antenna of FIG. 1 operates at a frequency of approximately 824 MHz.

FIG. 5 is a test chart showing exemplary radiation patterns on X-Y plane when the solid antenna of FIG. 1 operates at a frequency of approximately 824 MHz.

The description of the present disclosure has been presented for purposes of illustration and description, and is not intended to be exhaustive or limited to the disclosure in the form disclosed. Many modification and variations will be apparent to those of ordinary skill in the art. The embodiment was chosen and described in order to best explain the principles of the disclosure, the practical application, and to enable others of ordinary skill in the art to understand the disclosure for various embodiments with various modifications as suited to the particular use contemplated.

What is claimed is:

1. A solid antenna positioned on a substrate, the solid antenna comprising:

a feeding portion for feeding electromagnetic signals; and a radiating portion for transceiving the electromagnetic signals, the radiating portion comprising:

a first radiator positioned on a first plane, and electrically connecting to the feeding portion, the first radiator comprising a first inverted-U-shaped radiating section;

a second radiator positioned on the first plane, comprising a second inverted-U-shaped radiating section;

a third radiator positioned on a second plane, the second plane being perpendicular to the first plane, the third radiator being U-shaped;

a first connecting section electrically connecting the first radiator to the third radiator;

a second connecting section electrically connecting the second radiator to the third radiator; and a fourth radiator electrically connecting to the second radiator;

wherein the first connecting section, the second connecting section, and the fourth radiator comprise one radiating section positioned on a third plane, respectively, wherein the first plane, the second plane, and the third plane are at different levels.

2. The solid antenna as claimed in claim 1, wherein the third plane comprises a flat plane, and the first connecting section, the second connecting section, and the fourth radiator are positioned on the first plane, the second plane, and the third plane, respectively.

3. The solid antenna as claimed in claim 1, wherein the third plane comprises a curved surface, wherein the first connecting section, the second connecting section, and the fourth radiator are positioned on the curved surface.

4. The solid antenna as claimed in claim 1, wherein the first radiator further comprises a first rectangular-shaped radiating section, a second rectangular-shaped radiating section, an arc-shaped radiating section, and the first rectangular-shaped radiating section, wherein the first inverted-U-shaped radiating section, the arc-shaped radiating section, and the second rectangular-shaped radiating section electrically connected one-by-one in sequence.

5. The solid antenna as claimed in claim 4, further comprising a supporting portion connecting the first rectangular-shaped radiating section to the feeding portion.

6. The solid antenna as claimed in claim 4, wherein the second radiator further comprises a first S-shaped radiating section and a second S-shaped radiating section, wherein the first S-shaped radiating section, the second inverted-U-shaped radiating section, and the second S-shaped radiating section are electrically connected one-by-one in sequence.

7. The solid antenna as claimed in claim 6, wherein the third radiator further comprises a first connecting end and a second connecting end.

8. The solid antenna as claimed in claim 7, wherein the first connecting section electrically connects the second rectangular-shaped radiating section to the first connecting end, wherein a projection of the first connecting section onto the first plane is rectangularly-shaped.

9. The solid antenna as claimed in claim 7, wherein the second connecting section electrically connects the second S-shaped radiating section to the second connecting end, wherein a projection of the second connecting section onto the first plane is rectangularly-shaped.

10. The solid antenna as claimed in claim 7, wherein the fourth radiator is inverted C-shaped, and further comprises a U-shaped radiating section and a free section electrically connecting to the U-shaped radiating section.

11. The solid antenna as claimed in claim 10, wherein an opening direction of the U-shaped radiating section is substantially the same as an opening direction of the third radiator, and a size of the opening of the U-shaped radiating section is smaller than a size of the opening of the third radiator.

12. The solid antenna as claimed in claim 11, wherein the U-shaped radiation section of the fourth radiator electrically connects to the first S-shaped radiating section of the second radiator.

13. The solid antenna as claimed in claim 1, wherein the substrate is a printed circuit board.

14. A solid antenna, comprising:

a feeding portion for feeding electromagnetic signals; and a radiating portion comprising a plurality of radiating sections connected one-by-one to collectively form a helical-shaped configuration, wherein the plurality of radiating sections comprises a first radiating section positioned in the periphery of the helical-shaped configuration of the radiating portion being electrically connecting to the feeding portion, a last radiating section positioned in the center of the helical-shaped configuration of the radiating portion being a free section on a third plane that intersects between the first plane and the second plane, wherein the first plane, the second plane, and the third plane are at different levels;

wherein the first radiating section adjacent to the feeding portion is positioned on a first plane of the substrate, and a second radiating section apart from the feeding portion are positioned on a second plane of the substrate.

15. The solid antenna as claimed in claim 14, wherein the first radiating section, the second radiating section, and the third radiating section comprises rectangular-shaped radiation sections, U-shaped radiation sections, L-shaped radiation sections, or S-shaped radiation sections.

16. The solid antenna as claimed in claim 14, wherein the first radiating section positioned on the first plane comprise radiating sections physically connected to the feeding portion and radiating sections neighboring, but not touching the feeding portion.

17. The solid antenna as claimed in claim 14, wherein a plane where the feeding portion is positioned is perpendicular to the first plane.

18. The solid antenna as claimed in claim 17, wherein the second plane is parallel to the feeding portion.

* * * * *